United States Patent [19]

Knauer et al.

[11] Patent Number: 4,858,432

[45] Date of Patent: Aug. 22, 1989

[54] PILOT BURNER FOR AN APPARATUS FOR BURNING OFF SOLID PARTICLES IN THE EXHAUST GAS OF INTERNAL COMBUSTION ENGINES

[75] Inventors: Alfred Knauer, Stuttgart; Ulrich Projahn, Ditzingen, both of Fed. Rep. of Germany

[73] Assignee: Robert Bosch GmbH, Stuttgart, Fed. Rep. of Germany

[21] Appl. No.: 236,972

[22] Filed: Aug. 26, 1988

[30] Foreign Application Priority Data

Sep. 26, 1987 [DE] Fed. Rep. of Germany ..... 3732491

[51] Int. Cl.[4] ..... F01N 3/26

[52] U.S. Cl. ..... 60/303

[58] Field of Search ..... 60/303; 431/258, 262, 431/260, 347

[56] References Cited

U.S. PATENT DOCUMENTS 4,672,808 6/1987 Leonhard ..... 60/286
4,776,725 1/1988 Dettling .

FOREIGN PATENT DOCUMENTS 1551752 3/1970 Fed. Rep. of Germany .
1551725 12/1972 Fed. Rep. of Germany .

*Primary Examiner*—Douglas Hart
*Attorney, Agent, or Firm*—Edwin E. Greigg

[57] ABSTRACT

A pilot burner for a device for burning off solid particles, in particular soot particles, in the exhaust gas of internal combustion engines has a hollow-cylindrical mixture preparation chamber receiving a glow element and a hollow-cylindrical glow plug receiving chamber extending transversely to it and communicating with it through an opening. A fuel inflow line discharges into the receiving chamber and an air supply line discharges into the preparation chamber. To improve mixture preparation and largely avoid carbonization of the glow plug, the glow plug is coaxially surrounded in the vicinity of its coil at a radial distance by a protective sleeve. The fuel inflow line ends at an orifice fitting that protrudes radially into the receiving chamber and discharges immediately in front of the protective sleeve.

17 Claims, 2 Drawing Sheets

PILOT BURNER FOR AN APPARATUS FOR BURNING OFF SOLID PARTICLES IN THE EXHAUST GAS OF INTERNAL COMBUSTION ENGINES

BACKGROUND OF THE INVENTION

The invention relates to a pilot burner for a device for burning off solid particles, in particular soot particles, in the exhaust gas of internal combustion engines of the type described further hereinafter.

Burnoff devices of this kind are used in particular in motor vehicles having Diesel engines, for the direct disposal of the soot filtered out of the exhaust gas by electrostatic soot traps. Along with a secondary flow of exhaust gas that amounts to less than 1% of the total exhaust gas, this soot is delivered to the combustion chamber of the burnoff device, where it is burned at a flame temperature between 550° C. and 1000° C. The combustion products free of toxic substances, and the remaining gases, are expelled via the engine exhaust system. To generate the burnoff flame, a pilot burner, as described for example in German Offenlegungsschrift No. 36 21 914, is mounted on the combustion chamber of the burnoff device. In this pilot burner, embodied as a swirl burner, liquid fuel and combustion air in metered amounts are swirled in the mixture preparation chamber, and the mixture is delivered via the mixture outlet opening to the combustion chamber, where after ignition it burns off, along with the soot-laden exhaust gas. The ignition is effected by a glow plug, by the ignition of the mixture on its incandescent coil. After ignition of the mixture has been ignited and heating of the glow element in the mixture preparation chamber, the glow element takes on the function of stabilizing the flame formation, so that the glow plug can be switched off again and is needed only for the startup or intermittent operation of the burnoff device. The structure of the pilot burner is definitive for the quality of the mixture preparation and for the load on the glow plugs; accommodating the glow plug in the separate receiving chamber keeps it out of range of the flame, which prevents it from being thermally overloaded.

OBJECT AND SUMMARY OF THE INVENTION

The pilot burner according to the invention has the advantage over the prior art that on the one hand, the protective sleeve prevents the fuel flowing into the spark plug receiving chamber from meeting the coil of the glow plug, thus preventing carbonization of the coil and hence considerably prolonging the service life of the glow plug; on the other hand, because the protective sleeve is always hot, even when the glow plug is shut off, uniform evaporation of the fuel meeting the protective sleeve is assured. This results in very good mixture preparation and leads to a soot-free (blue) burner flame, even at a low ratio of combustion air to fuel.

The approximately vertical disposition of the receiving chamber and the disposition of the connecting opening between the receiving chamber and the mixture preparation chamber on the lower end of the receiving chamber not only makes manufacture of the pilot burner housing simpler, but also prevents fuel sump formation in the receiving chamber. This makes the pilot burner more stable in the presence of mechanical jarring than known pilot burners.

In an advantageous feature of the invention, the durability of the electrical connections of the glow plug is assured by cooling the receiving chamber jacket in the vicinity of the internally threaded portion that receives the plug connection thread. The cooling may be effected by cooling ribs extending radially or axially to the receiving chamber, on its circumference, or by an annular conduit encompassing the internally threaded portion, through which conduit the combustion air delivered to the mixture preparation chamber is carried. In the latter case, the combustion air is pre-heated at the same time, so that less energy is required to reach the temperature of ignition of the fuel-air mixture.

By embodying the burner orifice in front of the mixture outlet opening in various ways, for instance as a nozzle or as a diffusor, the shape of the flame can be adapted to various requirements.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
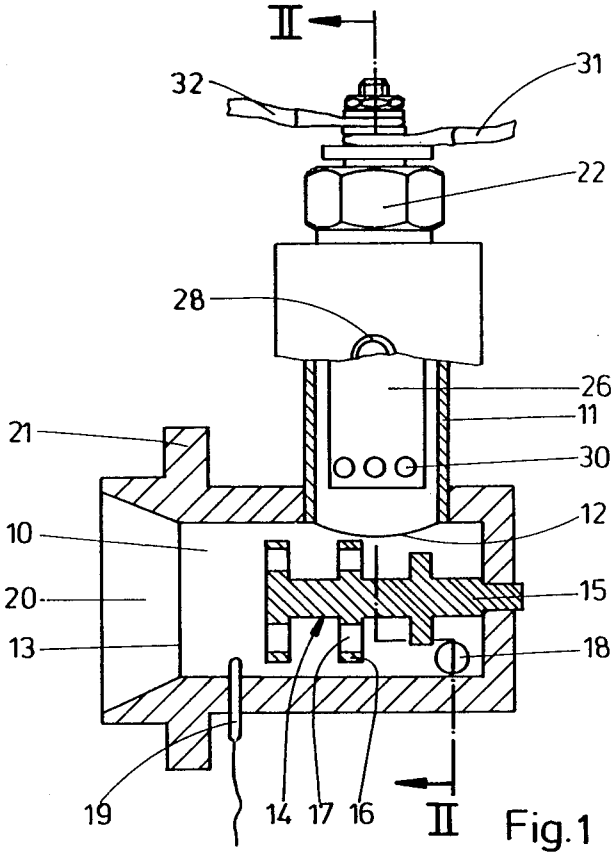
FIG. 1 is a longitudinal section through a pilot burner for a burnoff device in motor vehicles.
Figure 5:
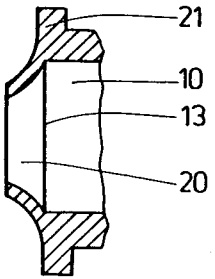
FIG. 5 is a longitudinal section through the end having the mixture outlet opening of a mixture preparation chamber of a fourth exemplary embodiment of a pilot burner.

The pilot burner, shown schematically in longitudinal section in FIG. 1 and in cross section in FIG. 2, has a hollow-cylindrical mixture preparation chamber 10, hereinafter denoted simply as the preparation chamber 10, and a glow plug receiving chamber 11, hereinafter alluded to simply as the receiving chamber 11. The two chambers 10, 11 extend at right angles to one another, with their longitudinal axes located in the same plane. In the installed position of the pilot burner, the preparation chamber 10 is approximately horizontal and the receiving chamber 11 is approximately verticle, the latter being inserted with one open face end into a circular-cylindrical opening 12 in the chamber wall of the preparation chamber 10. The preparation chamber 10. The preparation chamber 10 is closed at one face end, while on its other face end it has a mixture outlet opening 13, to which a combustion chamber, not shown in further detail, of the burnoff device is connected. A glow element 14 is disposed coaxially in the preparation chamber 10, being secured in the closed end wall of the preparation chamber 10 and extending through the preparation chamber 10 nearly as far as the mixture outlet opening 13. The glow element 14 has a plurality of annular ribs 16, for instance three in number, extending radially spaced apart from a shaft 15; the two annular ribs 16 located nearer the mixture outlet opening 13 have openings 17 distributed uniformly over their circumference. An air supply line 18 discharges near the closed end wall of the preparation chamber, with an inflow direction that is tangential to the preparation chamber 10. A thermal element 19 is disposed in the chamber wall near the mixture outlet opening 13 and protrudes radially into the preparation chamber 10 as far as the vicinity of the face end of the glow element 14. A burner orifice 20 that is integral with the chamber wall of the preparation chamber 10 is fitted onto the mixture outlet opeing 13, embodied as a diffusor, with a cross section that widens toward the free end. Alternatively, the burner orifice 20 may instead be embodied as a nozzle, with a cross section that tapers conically toward the free end, as shown in FIG. 5. In the vicinity of the burner orifice 20, the preparation chamber 10 has a radially offstanding fastening flange 21, which is integral with the chamber wall, for securing the pilot burner to the burnoff device.

Figure 2:
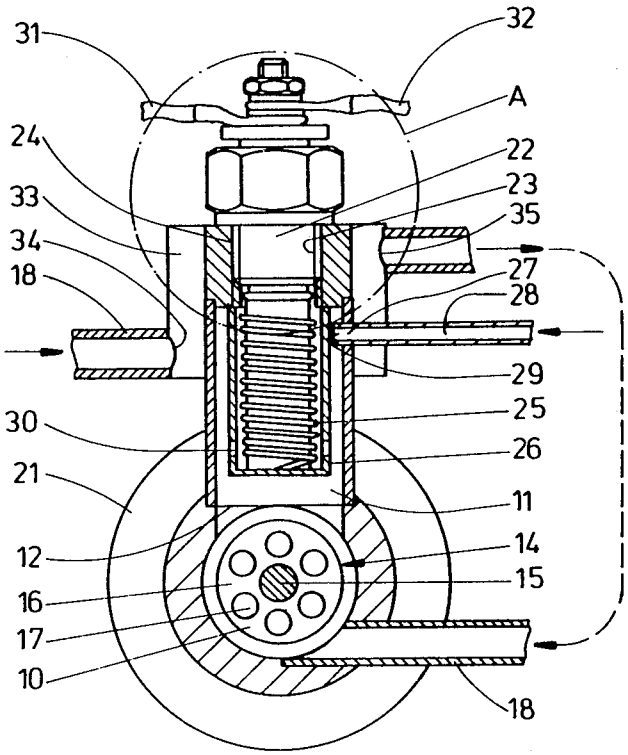
FIG. 2 is a section through the pilot burner taken along the line II—II of FIG. 1.

A glow plug 22 is coaxially held in the receiving chamber 11, by the screwing of a plug connection thread 23 into an internally threaded section 24 on the end of the receiving chamber 11 remote from the opening 12 (see FIG. 2). With its coil 25, the glow plug 22 protrudes to a point which near the opening 12 to the preparation chamber 10. In the vicinity of the coil 25, the glow plug 22 is coaxially surrounded in a radially spaced apart manner by a protective sleeve 26, which is made with thin walls for the sake of low thermal capacity and the associated rapid heating up time; the wall thickness is preferably in the range between 0.1 and 0.3 mm. An orifice fitting 27 of a fuel inflow line 28 protrudes radially inward into the receiving chamber 11, with its orifice 29 located immediately in front of the outer wall of the protective sleeve 26. This hot protective sleeve 26—which remains hot even if the glow plug 22 is temporarily shut off—assures uniform evaporation of the delivered fuel, which improves the fuel preparation. Moreover, because of the protective Moreover, because of the protective sleeve 26, the ;fuel cannot come into direct contact with the incandescent coil 25 of the glow plug 22, which largely prevents carbonization of the coil. To improve the ignition, bores 30 are provided in the protective sleeve 26 near its free open end, distributed uniformly over the circumference of the protective sleeve 26.

Figure 3:
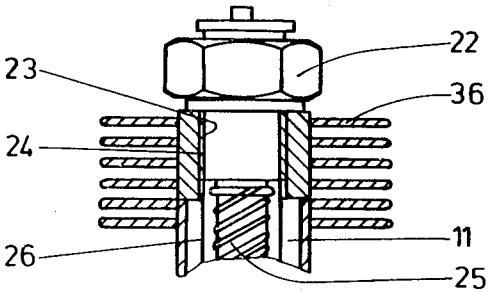
FIG. 3 is a longitudinal section taken in the vicinity of the area A of FIG. 2 through a second exemplary embodiment of a pilot burner.
Figure 4:
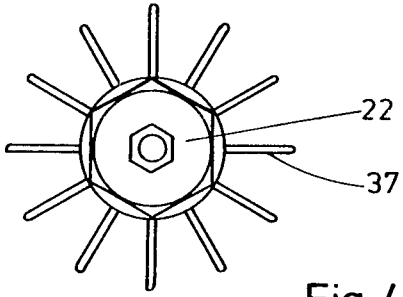
FIG. 4 is a plan view of the area A of FIG. 2 in a third exemplary embodiment of a pilot burner.

The glow plug 22 is supplied with current via two electric connection lines 31 and 32. To avoid overheating of the electric connections, the receiving chamber 11 is cooled in the vicinity of its internally threaded section 24. In the exemplary embodiment of FIGS. 1 and 2, the cooling is effected by the combustion air delivered to the preparation chamber 10. To this end, the jacket of the receiving chamber 11 is surrounded in the vicinity of the internally threaded section 24 by an annular conduit 33, which with an inlet opening 34 and an outlet opening 35 is interpolated into the air supply line 18 (FIG. 2). As it flows through the annular conduit 33, the combustion air absorbs heat, which on the one hand cools the connection of the glow plug 22 and on the other hand pre-heats the combustion air, which makes for a certain savings in energy in the heating of the mixture of fuel and combustion air to its temperature of ignition. In a simplified embodiment, cooling ribs could be used to cool the plug connection thread 23, instead of the annular conduit 33. In the exemplary embodiment of FIG. 3, radial cooling ribs 36 are mounted on the jacket of the receiving chamber 11, in the vicinity of the internally threaded section 24. As shown in the exemplary embodiment of FIG. 4, axial cooling ribs 37 may be provided instead, extending on the outer jacket of the receiving chamber 11 over the entire range of the internally threaded section 24.

The mode of operation of the pilot burner described is as follows:

For startup of the burner device, the glow plug 22 of the pilot burner is first supplied with current, and fuel is directed through the fuel inflow line 28 into the receiving chamber 11. At the same time, combustion air is fed via the air supply line 18 into the preparation chamber 10, where because of its tangential inflow direction it generates a rotary flow. The fuel meeting the protective sleeve 26, which has been heated by the glow plug 22, evaporates and mixes in the preparation chamber 10 with the combustion air. When a specified temperature is attained, the fuel-air mixture ignites, and the flame shoots through the mixture outlet opening 13 into the adjoining combustion of the burnoff device. After some time, the glow element 14 attains the ignition temperature, so that the flame formation is stabilized. The glow plug 22 is now switched off. The ignition flame shooting with a swirl through the mixture outlet opening 13 into the combustion chamber is concentrated in the axis of the combustion chamber by the embodiment of the burner orifice as a nozzle (FIG. 5), so that in the middle of the combustion chamber, a very hot core combustion zone develops, in which the soot particles delivered to the combustion chamber along with the secondary exhaust gas flow are quickly brought to the reaction temperature. By embodying the burner orifice as a diffusor (FIG. 1), the core combustion zone can be shifted and made wider. The intensity of the swirl of the fuel-air mixture necessary for stable combustion can be varied by modifying the cross section of the air supply line 18. The thermal element 19 or some other sensor that senses the flame temperature of the pilot burner serves to monitor the pilot burner and to regulate the burner temperature to a constant value.

The foregoing relates to preferred exemplary embodiments of the invention, it being understood that other variants and embodiments thereof are possible within the spirt and scope of the invention, the latter being defined by the appended claims.

What is claimed and desired to be secured by letters patent of the United States is:

1. A pilot burner for a device for burning off solid particles, in the exhaust gas of internal combustion engines, comprising a hollow-cylindrical mixture preparation chamber, a glow element therein, said preparation chamber being closed at one face end and at the other provided with a mixture outlet opening, a hollow-cylindrical receiving chamber, adapted to receive a glow plug, arranged to extend transversely to and communicate with the mixture preparation chamber, a fuel inflow line arranged to discharge into the receiving chamber, a tangentially disposed air inflow supply line associated with said mixture preparation chamber, said glow plug (22) being surrounded coaxially, in a radially spaced apart manner, in the vicinity of an incandescent coil (25) by a thin-walled protective sleeve (26), and further that the fuel inflow line (28) includes an orifice fitting (27) which protrudes radially into the receiving chamber (11), said orifice fitting having an orifice opening (29) which terminates in close proximity to the protective sleeve (26).

2. A pilot burner as defined by claim 1, in which the mixture preparation chamber (10) and the receiving chamber (11) have axes which are located in the same plane, and that the receiving chamber (11) discharges with one open face end into a circular-cylindrical opening (12) in the chamber wall of the mixture preparation chamber (10).

3. A pilot burner as defined in claim 2, in which the installed position of the pilot burner, the receiving chamber (11) is adapted to rest with an approximately vertical alignment above the mixture preparation chamber (10), which has an approximately horizontal alignment.

4. A pilot burner as defined by claim 1, in which the protective sleeve (26) has a lower portion, said lower portion having uniformly distributed radial bores (30) on its circumference.

5. A pilot burner as defined by claim 2, in which the protective sleeve (26) has a lower portion, said lower portion having uniformly distributed radial bores (30) on its circumference.

6. A pilot burner as defined by claim 3, in which the protective sleeve (26) has a lower portion, said lower portion having uniformly distributed radial bores (30) on it circumference.

7. A pilot burner as defined by claim 1, in which the orifice of the air supply line (18) is located near the closed face end of the mixture preparation chamber (10).

8. A pilot burner as defined by claim 2, in which the orifice of the air supply line (18) is located near the closed face end of the mixture preparation chamber (10).

9. A pilot burner as defined by claim 3, in which the orifice of the air supply line (18) is located near the closed face end of the mixture preparation chamber (10).

10. A pilot burner as defined by claim 4, in which the orifice of the air supply line (18) is located near the closed face end of the mixture preparation chamber (10).

11. A pilot burner as defined by claim 1, in which the receiving chamber (11) has an internally threaded section (24) arranged to receive the glow plug (22) and further that the receiving chamber (11) includes a jacket which is cooled in the vicinity of the internally threaded section (24).

12. A pilot burner as defined by claim 2, in which the receiving chamber (11) has an internally threaded section (24) arranged to receive the glow plug (22) and further that the receiving chamber (11) includes a jacket which is cooled in the vicinity of the internally threaded section (24).

13. A pilot burner as defined by claim 3, in which the receiving chamber (11) has an internally threaded section (24) arranged to receive the glow plug (22) and further that the receiving chamber (11) includes a jacket which is cooled in the vicinity of the internally threaded section (24).

14. A pilot burner as defined by claim 4, in which the receiving chamber (11) has an internally threaded section (24) arranged to receive the glow plug (22) and further that the receiving chamber (11) includes a jacket which is cooled in the vicinity of the internally threaded section (24).

15. A pilot burner as defined by claim 7, in which the receiving chamber (11) has an internally threaded section (24) arranged to receive the glow plug (22) and further that the receiving chamber (11) includes a jacket which is cooled in the vicinity of the internally threaded section (24).

16. A pilot burner as defined by claim 11, in which the jacket of the receiving chamber (11) includes cooling ribs (36, 37) adapted to protrude at right angles in the vicinity of the internally threaded section (24).

17. A pilot burner as defined by claim 11, in which the jacket of the receiving chamber (11) is surrounded, in the vicinity of the internally threaded section (24), by an annular conduit (33), which is interpolated into the air supply line (18) with an inlet and an outlet (34 and 35).

* * * * *